US009114918B2

(12) United States Patent
De Rosa

(10) Patent No.: US 9,114,918 B2
(45) Date of Patent: Aug. 25, 2015

(54) ANTI-DRIP CAP WITH AUTOMATIC MOVABLE COVER AND HIGHLY EFFICIENT SEAL

(75) Inventor: Daniel De Rosa, Louviers (FR)

(73) Assignee: MAITRISE ET INNOVATION, Val de Reuil (FR)

( * ) Notice: Subject to any disclaimer, the term of this patent is extended or adjusted under 35 U.S.C. 154(b) by 0 days.

(21) Appl. No.: 14/235,504

(22) PCT Filed: Jul. 25, 2012

(86) PCT No.: PCT/EP2012/064562

§ 371 (c)(1),
(2), (4) Date: Jan. 28, 2014

(87) PCT Pub. No.: WO2013/017492

PCT Pub. Date: Feb. 7, 2013

(65) Prior Publication Data

US 2014/0202981 A1 Jul. 24, 2014

(30) Foreign Application Priority Data

Aug. 1, 2011 (FR) ..... 11 57039

(51) Int. Cl.
*B65D 41/04* (2006.01)
*B65D 47/20* (2006.01)

(52) U.S. Cl.
CPC ..... *B65D 41/0471* (2013.01); *B65D 47/2087* (2013.01)

(58) Field of Classification Search
CPC ..... B65D 47/2087; B65D 41/0471
USPC ..... 222/513, 519–522, 546, 153.11, 108; 215/320, 329, 334, 335, 265, 272, 276
See application file for complete search history.

(56) References Cited

U.S. PATENT DOCUMENTS

| | | | |
|---|---|---|---|
| 7,748,580 | B2 | 7/2010 | Berthelin et al. |
| 8,464,916 | B2 | 6/2013 | De Rosa |
| 2010/0230376 | A1 | 9/2010 | De Rosa et al. |

FOREIGN PATENT DOCUMENTS

| | | |
|---|---|---|
| DE | 84 23 567 | 9/1985 |
| DE | 87 15 396 | 3/1988 |
| DE | 43 28 582 | 3/1995 |
| FR | 2 857 653 | 1/2005 |
| FR | 2 922 527 | 4/2009 |
| FR | 2 945 518 | 11/2010 |
| GB | 1 023 955 | 3/1966 |

OTHER PUBLICATIONS

International Search Report dated Sep. 7, 2012, corresponding to PCT/EP2012/064562.

*Primary Examiner* — Andrew Perreault
(74) *Attorney, Agent, or Firm* — Young & Thompson

(57) ABSTRACT

A so-called "anti-drip" cap (10) for a deformable bottle (12), includes a substantially tubular base (16), a substantially tubular cover (26), which covers the base (16) in an impermeable manner, and which includes at least one so-called upper opening (30) for outlet of the product, first and second tubular sections (22, 23) of the base and of the cover being mounted in a sliding manner, one within the other, and defining, in an impermeable manner, a chamber (32) for passage of the product, characterized in that the internal tubular section end (33) placed inside the passage chamber (32) includes at least one first substantially tapered lip (35) that touches an inner bore of the external tubular section.

17 Claims, 6 Drawing Sheets

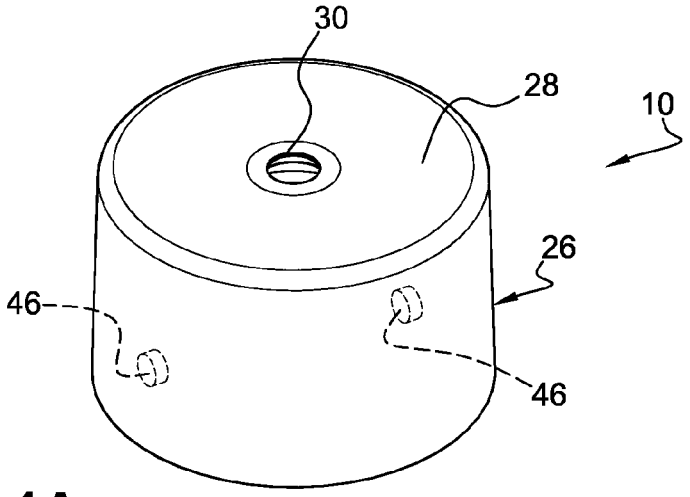
Fig. 1A
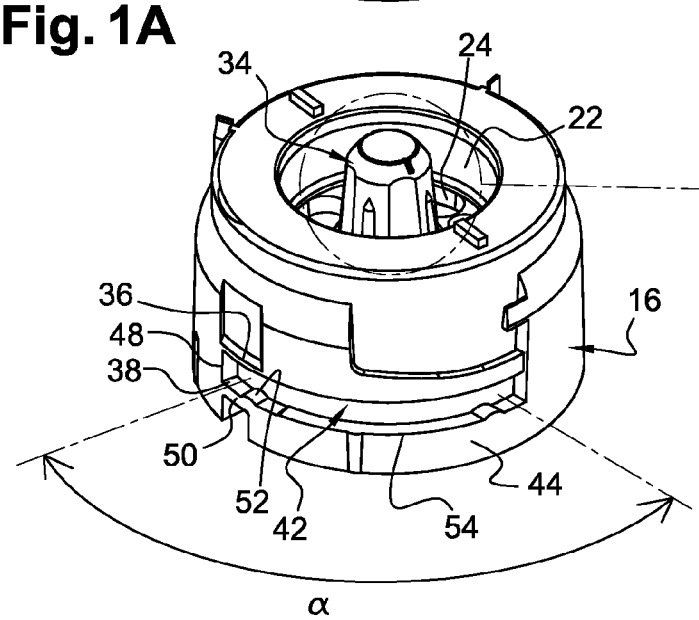
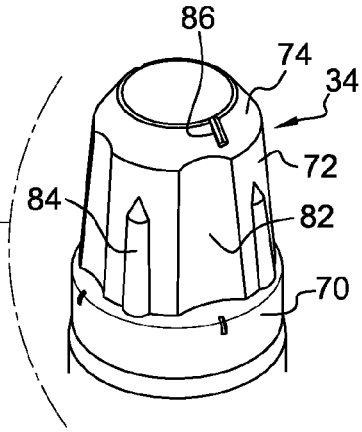
Fig. 1B
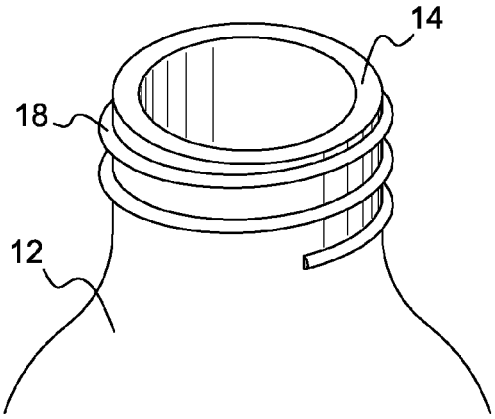

Fig. 1C
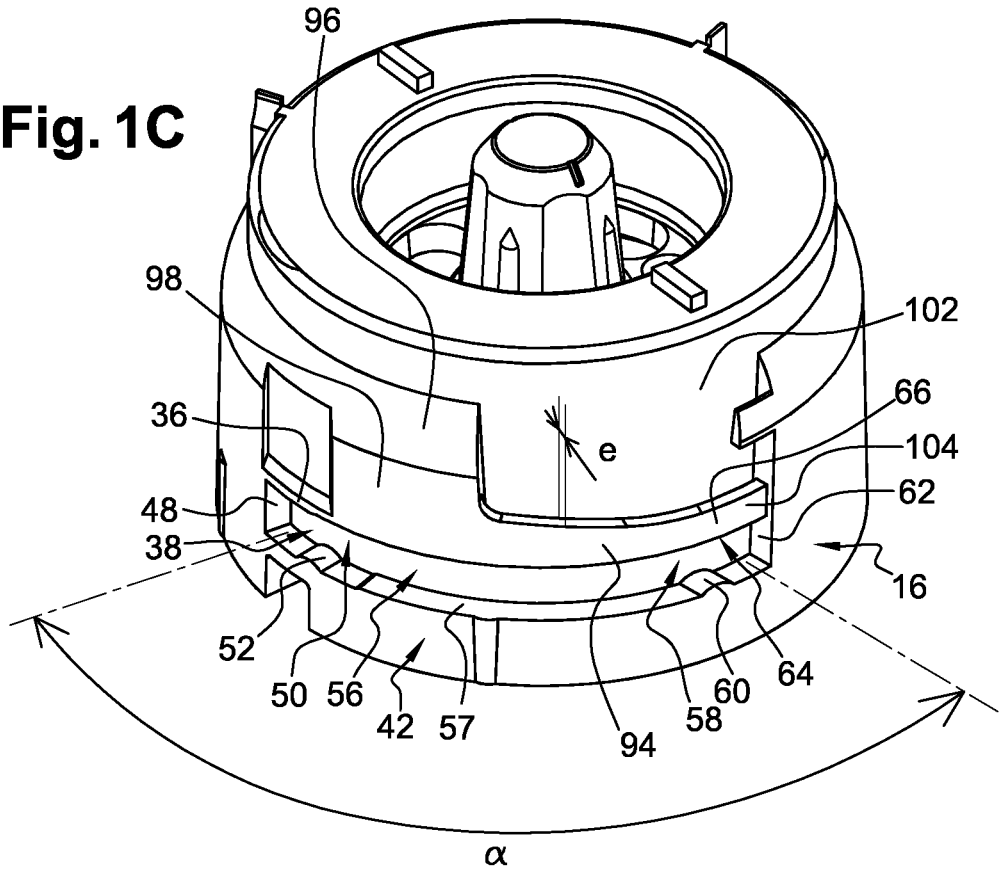
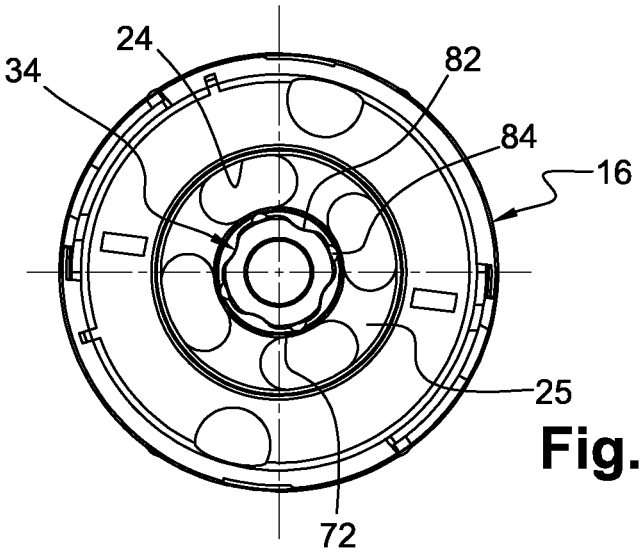
Fig. 1D

Fig. 4A
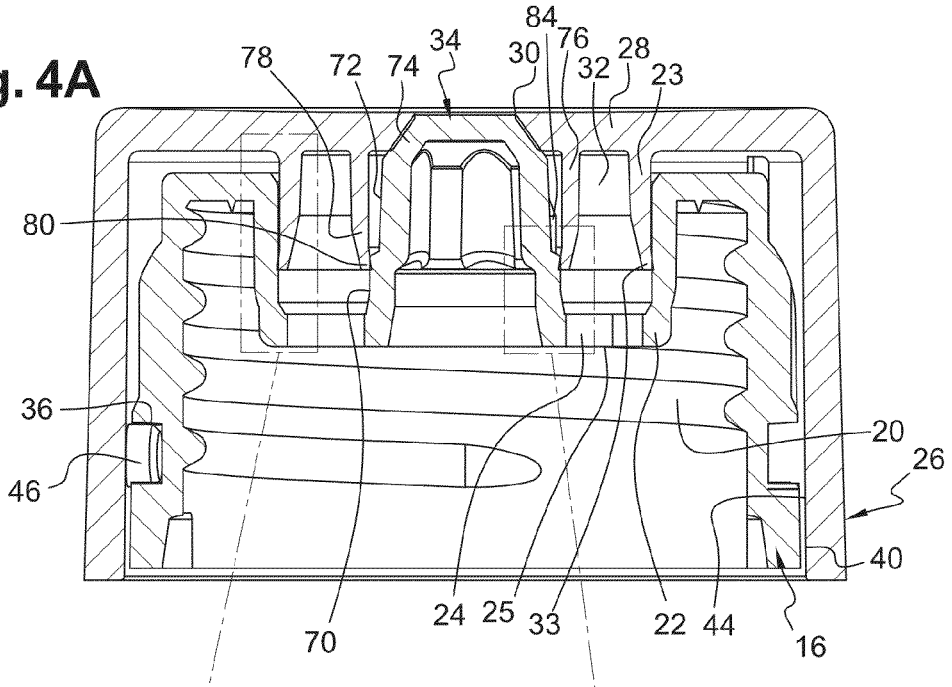
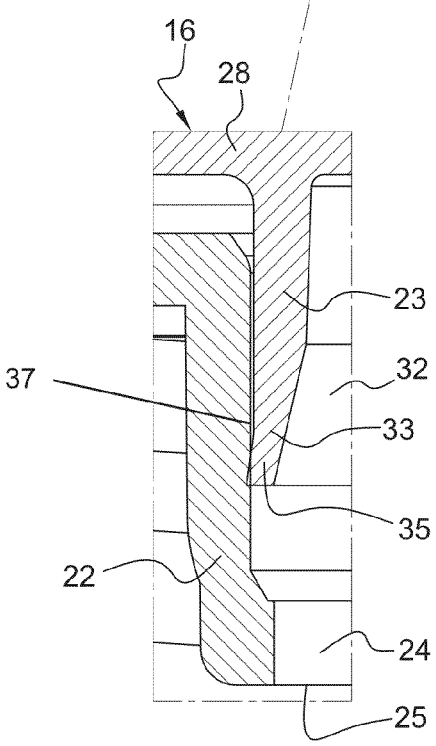
Fig. 4B
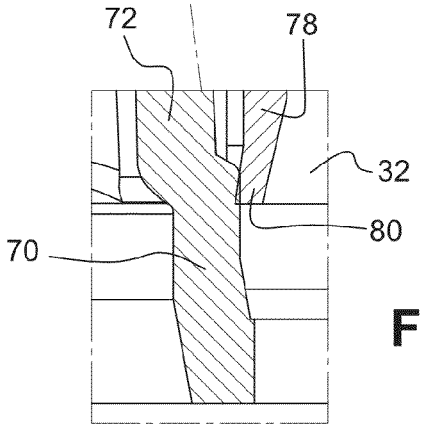
Fig. 4C
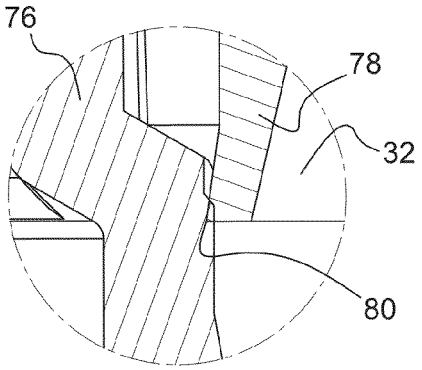
Fig. 4D

ANTI-DRIP CAP WITH AUTOMATIC MOVABLE COVER AND HIGHLY EFFICIENT SEAL

BACKGROUND OF THE INVENTION

The invention relates to a so-called "anti-drip" cap for a deformable bottle.

The invention relates, more particularly, to a so-called "anti-drip" cap for a deformable bottle, particularly a squeeze bottle, containing a cosmetic, pharmaceutical, industrial or food product in liquid or cream form, including:

- a substantially tubular base, which is intended to be fixed in an impermeable manner on a complementary tubular neck of the bottle, and a first tubular section of which includes at least one lower inlet opening connecting with the neck of the bottle,
- a substantially tubular cover, which covers the base in an impermeable manner, and a second tubular section of which is closed by at least one "upper" transverse wall including at least one so-called upper opening for outlet of the product, the first and second tubular sections being mounted in a sliding manner, one within the other, and defining, in an impermeable manner, a chamber for passage of the product, which chamber is interposed between the inlet opening of the base and the outlet opening for the product, an end of one of the so-called internal tubular sections, which end is mounted in a sliding manner inside the other so-called external section, being placed inside the passage chamber, said cover being vertically movable between at least:

- a sealing and locking low position in which the cover is immobilized on the base and in which the product outlet opening is lowered onto a sealing element which projects coaxially with the base from the upper transverse wall thereof, said sealing element sealing the product outlet opening,
- an intermediate position, in which the relative positions of the cover and of the base define an escape path with small dimensions connecting the product outlet opening with the passage chamber in order to ventilate the squeeze bottle allowing, in particular, the squeeze bottle to regain the shape thereof once pressed,
- a dispensing high position in which the outlet opening is placed with a defined high clearance above the sealing element in order to allow the product to pass through the inlet and outlet openings and the passage chamber, once the squeeze bottle is pressed.

DESCRIPTION Of THE RELATED ART

Numerous examples of caps of this type are known.

Such a cap is commonly used in the cosmetic or food industry to dispense a creamy product.

Such a cap, however, has the disadvantage of only including one sealing low position or one dispensing high position.

Therefore, such a cap needs to be handled each time that it must be used in order to open it, at the risk of the product contained therein drying and blocking the product outlet opening.

Moreover, such a cap cannot remain in the dispensing high position without the risk of it being knocked over and, therefore, the product contained therein escaping therefrom.

SUMMARY OF THE INVENTION

To overcome this disadvantage, an anti-spill cap is proposed, the product outlet opening of which only opens when the cap is supplied with product, for example when pressure is exerted on a squeeze bottle on which the cap is screwed.

Such a cap, nevertheless, has impermeability problems when it is not used, since the product tends to seep between the first and second angular sections and escape out of the passage chamber, consequently then seeping between the base and the cover.

The invention solves this disadvantage by proposing increased impermeability of the passage chamber.

To this end, the invention proposes an anti-drip cap of the type described above, characterized in that the internal tubular section end placed inside the passage chamber includes at least one first substantially tapered lip that touches an inner bore of the external tubular section.

According to other features of the invention:

- the first lip has a defined flexibility intended to press the lip against said bore once the passage chamber is subjected to the pressure of the product when the squeeze bottle is pressed,
- the second so-called internal tubular section is mounted in a sliding manner inside the first so-called external tubular section and it includes the first lip,
- the sealing coaxial element includes a fourth cylindrical lower section, a fifth intermediate section with a substantially tapered shape, the diameters of which are less than that of the fourth section, and a sixth tapered upper section that is complementary to the opening of the cover, and the cover includes a seventh tubular section, which extends coaxially inside the second tubular section from the upper transverse wall, with a diameter corresponding to that of the fourth section of the sealing element, and the free end of which, which is placed at the junction of the fourth and fifth sections in the intermediate position of the cover in order to ventilate the bottle, includes a second tapered lip intended to touch the fourth lower section of the sealing coaxial element,
- the second lip has a defined flexibility which is intended to press the lip against the fourth lower section once the passage chamber is subjected to the pressure of the product when the squeeze bottle is pressed,
- the fifth section of the sealing coaxial element includes at least three channels angularly spread in a regular manner on the periphery thereof in order to improve the passage of the product and/or air in the passage chamber,
- the fifth section of the sealing coaxial element includes at least three bosses, each of which projects radially between two successive channels, and which are intended to guide the seventh tubular section of the cover onto the sealing element,
- the cover is mounted pivotably and manually between:
  - a first angular position in which the cover can be immobilized and in which it occupies a sealing and locking low position defined by an upper stop which is rigidly connected to the base,
  - at least one second intermediate angular position, in which the cover is released from the stop and is placed with a reduced clearance (j) from the base in order to:
    - allow the alignment and the connection of a countersink formed in the periphery of the sixth tapered upper section of the sealing element with a conduit, formed in the upper wall of the cover, which connects the periphery of the opening and the passage chamber,
    - match up the free end of the seventh section of the cover with the junction of the fourth and fifth sections, in order to ventilate the bottle, a third angular position in which the cover can be immobilized, and in which it can occupy the dispensing high position with the high clearance once an injection of product coming from the neck of the bottle exerts, on the upper wall of the passage chamber, a pressure that is sufficient for a resulting force to exceed the force of a defined-stiffness elastic return means which is interposed in the third angular position between the cover and the base, an inner tubular bearing area of the cover includes at least one pin, projecting radially towards the inside of the cover, which is intended to engage at least one oblong hole which extends in the periphery of a lower end of the base along an angular sector corresponding to the angle formed between the first and second angular positions, and the profile of which allows the cover to be urged from the first position thereof for locking to the third position thereof, by way of the second intermediate position thereof, the hole includes:

a first section, with a width corresponding to the height of the pin, including a first end of the hole, an upper edge of which defines an upper stop position of the pin allowing the cover to be immobilized in the sealing low position, a second section, with a width corresponding to the height of the pin, including a first boss, borne in particular by a lower edge of the hole, which is placed at a distance from the first hole end corresponding substantially to the width of the pin, which defines, with the first end, the first angular position associated with the sealing low position, and which the pin can cross over when the cover is rotated, a third section, with a width corresponding to the height of the pin, including a first bearing, borne at least by a lower edge of the hole, which is intended to raise the pin and the cover to the defined reduced clearance "j" once the first bearing has been crossed from a defined angle of rotation, in order to define the second intermediate angular position associated with the ventilation of the bottle, a fourth section, with a width corresponding to the height of the pin, including a second boss, borne in particular by a lower edge of the hole, which is placed at a distance from a second end of the hole corresponding substantially to the width of the pin, which defines, with the second end, the third angular position associated with the dispensing high position, and which the pin can cross over when the cover is rotated, a fifth section, which extends between the second boss and the second end of the hole, once the second boss has been crossed from a defined angle of rotation, an elastically returned upper edge of which is intended to allow the pin of the cover to be raised to the high clearance "J", once an injection of product coming from the neck of the bottle exerts, on the upper wall of the passage chamber, a pressure which is sufficient for a resulting force to exceed the force of the elastic return means of said upper edge in order to define the third intermediate angular position associated with the dispensing high position, the upper edge of the fifth section is borne by an elastic lug, a first end of which consists of a single piece with a first cylindrical part of a body of the base, and which extends with a defined clearance about a second cylindrical part of the body of the base, a second end of which is free, and a lower edge of which forms at least the upper edge of the fifth section, the inner tubular bearing area of the cover includes at least two diametrically opposite pins, and the base includes two elastic lugs and two holes which are diametrically opposite, the base includes at least two holes in the shape of crescents which are angularly spread in a regular manner about the sealing element, which each form an inlet opening for the passage chamber, a lower end of the base and the cover include complementary cylindrical bearing areas intended to engage one another in order to provide additional vertical guidance of the cover, the base and the cover are each made from an injected plastic.

BRIEF DESCRIPTION OF THE DRAWING FIGURES

Other features and advantages of the invention will emerge upon reading the following detailed description with reference to the appended drawings wherein:

FIG. 1A is an exploded perspective view with extraction of an anti-drip cap according to the invention;

FIG. 1B is a detail perspective view of the sealing means of the base;

FIG. 1C is a perspective detail view of the base of the cap,

FIG. 1D is a top view of the base of the cap;

FIG. 4A is a sectional view of the cap in the first angular position of the cover, which position is associated with the sealing and locking low position thereof;

FIGS. 4B-4D are detail views of the cap in the position of FIG. 4A;

DETAILED DESCRIPTION OF THE INVENTION

In the following description, identical reference numbers designate pieces that are identical or have similar functions.

The figures show a so-called "anti-drip" cap 10 produced in accordance with the invention.

In a known manner, the cap 10 is intended to be provided for a deformable bottle 12 for a cosmetic, pharmaceutical, industrial or food product, in liquid or cream form.

It will, therefore, be understood that the field of use of the cap 10 is extremely varied.

The deformable bottle 12 can, particularly, be a rigid bottle with one movable wall. This type of bottle is widely known from the prior art and is, for example, used to contain toothpastes.

In such a bottle, the volume of the bottle varies with the use thereof, since the movement of the movable wall accompanies the discharge of the product. The volume of the bottle is, in this case, always fully filled with product.

The bottle 12 can also be a squeeze bottle which is intended to be pressed in order to cause the product to be discharged. The contraction of the bottle accompanies the discharge of the product.

In such a bottle, when the bottle has regained the shape thereof, the volume of the bottle does not change on the whole, since the product which is discharged from the bottle has been replaced with air when the pressure exerted on the bottle has been released.

In the remainder of the present description, the invention will be explained with reference to a squeeze bottle 12, but it will be understood that this arrangement cannot limit the invention.

As illustrated in FIG. 1A, the bottle 12 includes a neck 14. In a known manner, the cap 10 includes a substantially tubular base 16, which is intended to be fixed in an impermeable manner on the complimentary tubular neck 14 of the bottle 12.

Figure 2:
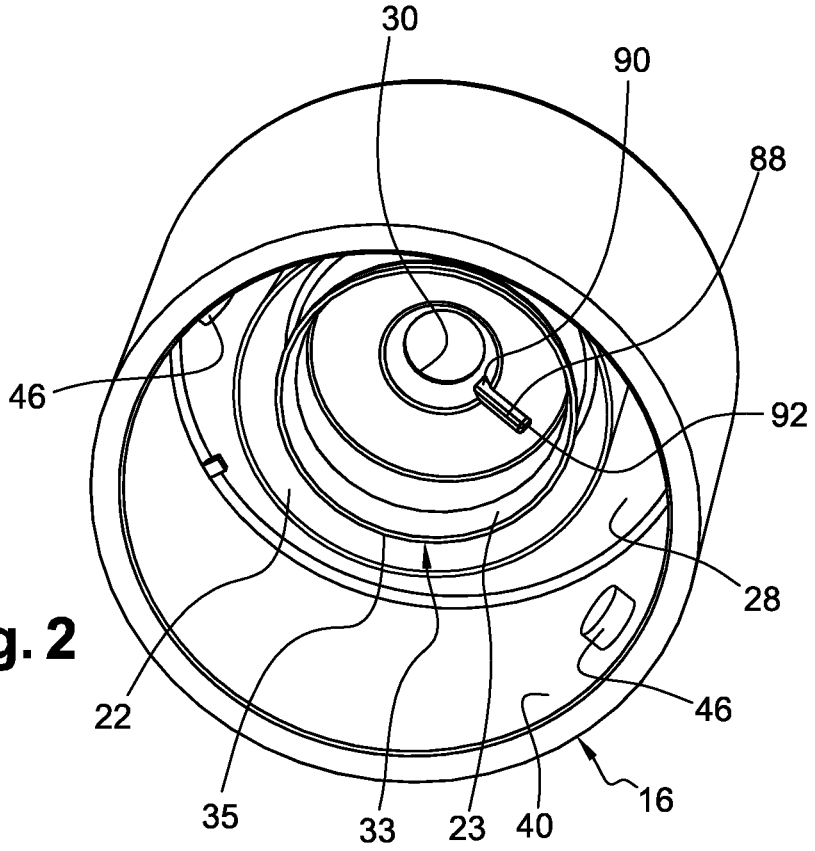
FIG. 2 is a perspective view of the cover.
Figure 3:
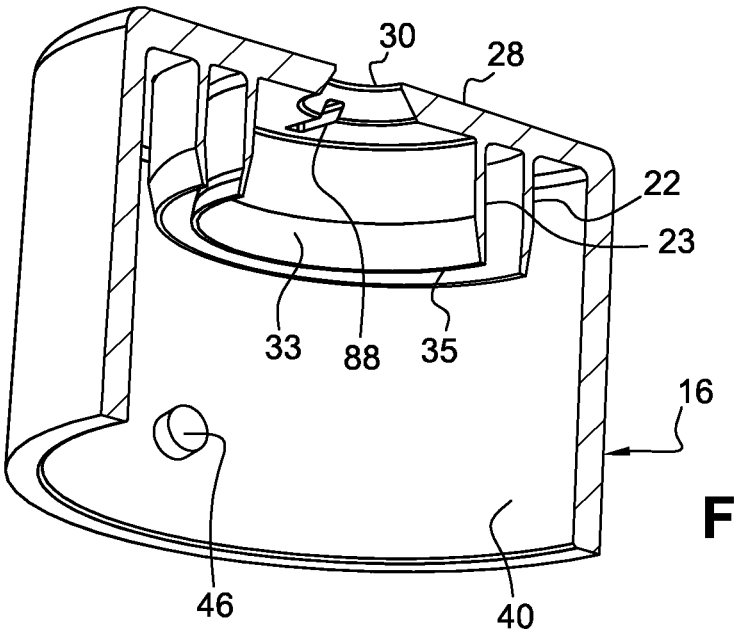
FIG. 3 is a perspective view of a cover cut along a vertical mid-plane.
Figure 5A:
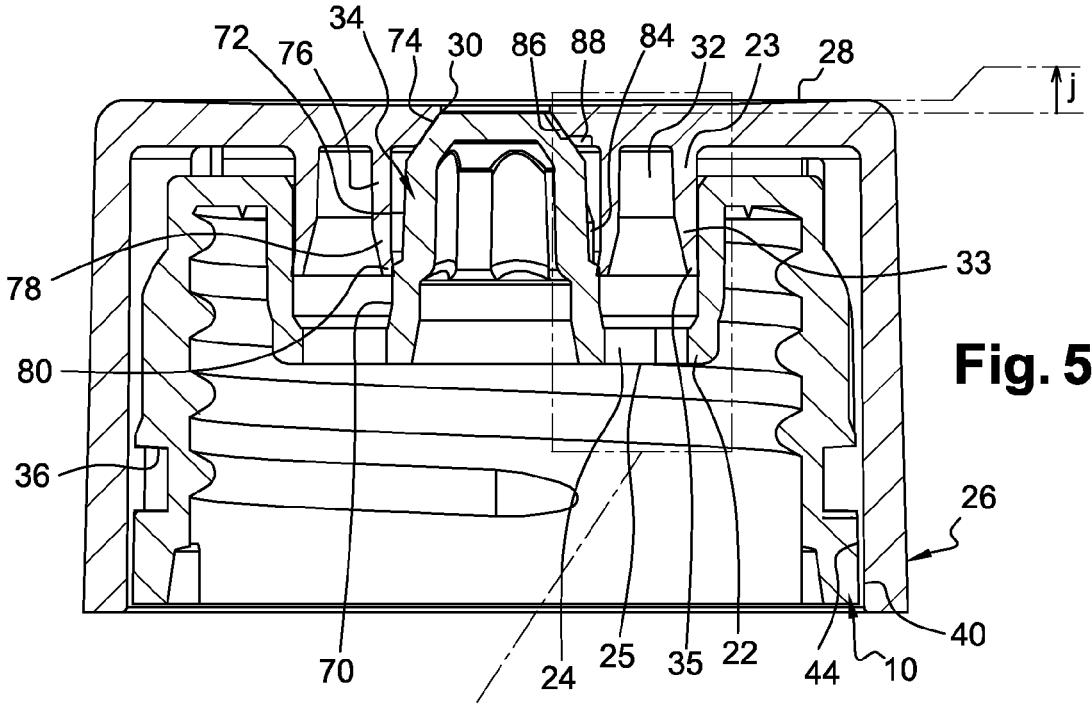
FIG. 5A is a sectional view of the cap in the second angular position of the cover, which position is associated with the intermediate position thereof for ventilating the bottle.
Figure 6A:
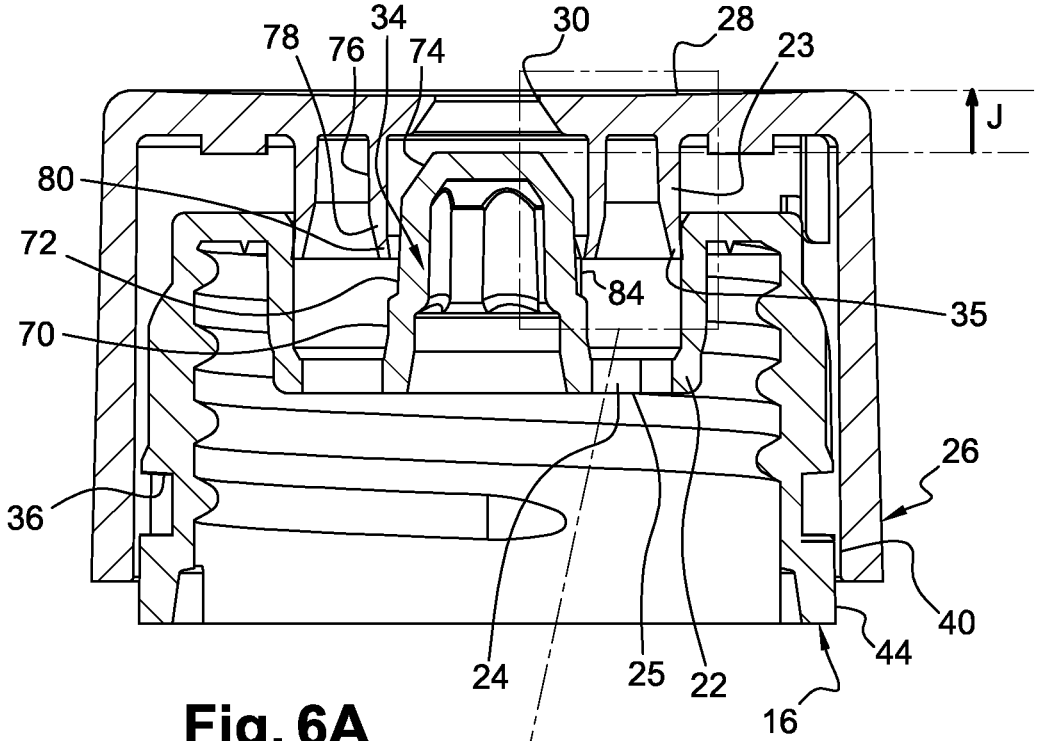
FIG. 6A is a sectional view of the cap in the second angular position of the cover, which position is associated with the dispensing high position thereof.

By way of example, and in a manner which does not limit the invention, the neck 14 of the bottle 12 includes threads 18 which are intended to receive a complementary internal thread 20 of the base 16, as shown in FIGS. 4A, 5A and 6A.

As illustrated more particularly in FIGS. 4A, 5A and 6A, the base 16 includes a first tubular section 22 which includes a transverse wall 25 including at least one inlet opening 24 which is intended to connect with the neck 14 of the bottle 12.

The base 16 receives a substantially tubular cover 26, which covers, in an impermeable manner, the base 16, and a second tubular section 23 of which is closed by at least one so-called "upper" transverse wall 28 which includes at least one product outlet opening 30.

The first and second sections 22, 23 are mounted in a sliding manner, one within the other, and define, in an impermeable manner, a chamber 32 for passage of the product, which chamber is interposed between the inlet opening 24 of the base and the product outlet opening 30. An end 33 of one of the sections is, therefore, placed inside the passage chamber 32.

In a known manner, the cover 26 is vertically movable between at least:

- a sealing and locking low position, which is shown in FIG. 4A, in which the cover 26 is immobilized on the base 16 and in which the product outlet opening 30 is lowered onto a sealing element 34 which projects coaxially with the base 16 from the upper transverse wall 25, such that said sealing element 34 seals the product outlet opening 30,
- an intermediate position, which is shown in FIG. 5A, in which the relative positions of the cover 26 and of the base 16 define an "escape path" with small dimensions for connecting the product outlet opening 30 with the passage chamber 32, in order to ventilate the squeeze bottle which allows, in particular, the squeeze bottle to regain the shape thereof once pressed, and
- a dispensing high position, which is shown in FIG. 6A, in which the outlet opening 30 is placed with a defined high clearance "J" above the sealing element 34 in order to allow the product to move through the inlet and outlet openings 24 and 30 and the passage chamber 32, once the squeeze bottle is pressed.

It will be understood that the end 33 of one of the sections which is placed inside the passage chamber 32 is directly subjected to the pressure of the product when the latter passes through the passage chamber 32. Therefore, this end 33 is a to potential escape point for the product.

Figure 5B:
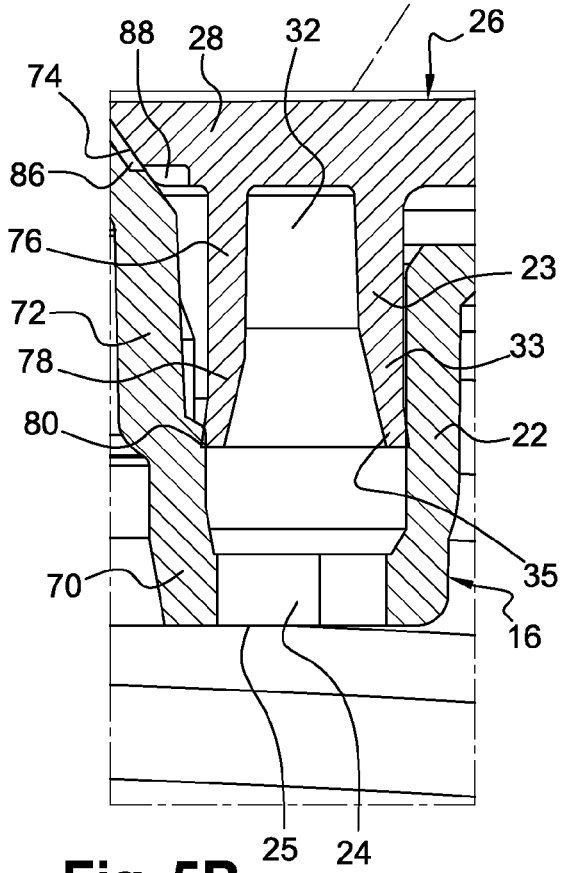
FIGS. 5B and 5C are detail views of the cap in the position of FIG. 5A.
Figure 5C:
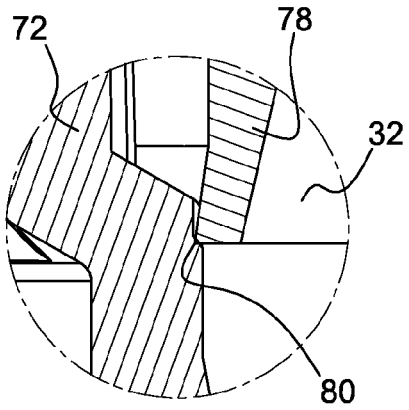
Figure 6B:
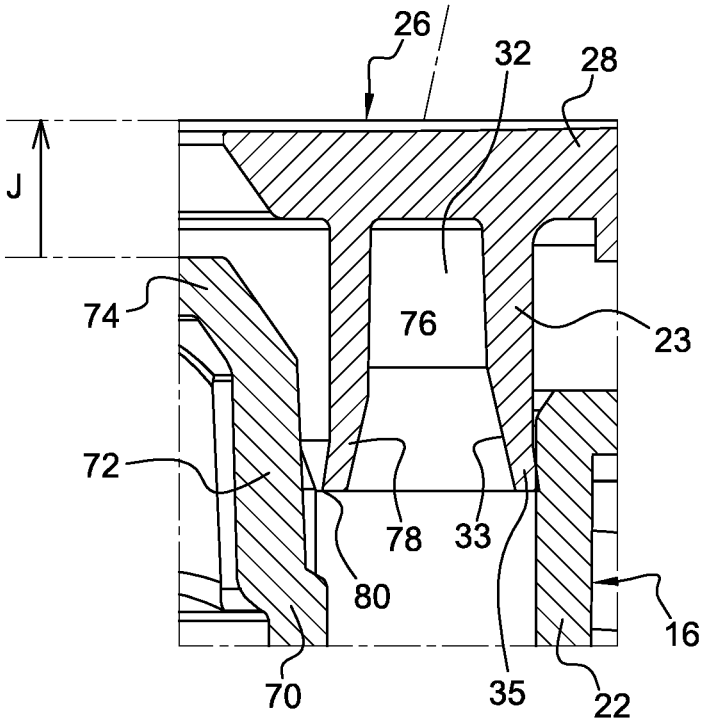
FIG. 6B is a detail view of the cap in the position of FIG. 6A.

To overcome this disadvantage, the invention proposes a cap of the type described above, characterized in that the end 33 of the internal tubular section includes at least one first tapered lip 35 which touches an internal bore 37 of the external tubular section, as shown particularly in FIGS. 4B, 5B, 6B.

In the preferred embodiment of the invention, it is the so-called internal second tubular section 23 of the cover which is mounted in a sliding manner inside the so-called external first tubular section 22 of the base 16, and which includes the first lip 35. Of course, this configuration does not limit the invention.

Preferably, the first lip 35 has a defined flexibility, which is intended to press the lip 35 against the bore of the first section 22 once the passage chamber 32 is subjected to the pressure of the product when the squeeze bottle is pressed.

This configuration is particularly advantageous, since the greater the pressure prevailing in the passage chamber 32 is, the more the lip is pressed against the bore of the first section 22 and the more impermeability is increased.

Furthermore, as illustrated in FIG. 1B, the sealing coaxial element 34 includes a fourth cylindrical lower section 70, a fifth intermediate section 72 with a substantially tapered shape, the diameters which are less than that of the fourth section 70, and a sixth tapered upper section 74 which is complementary to the opening 30 of the cover.

The base 16 includes at least two holes 24 in the shape of crescents which are angularly spread in a regular manner about the sealing element 34, and more particularly about the bottom of the fourth cylindrical lower section 70, which each form an inlet opening 24, as shown, in particular, in FIG. 1D.

The cover 26 includes a seventh tubular section 76, which extends coaxially inside the second tubular section 23 from the upper transverse wall 28. The seventh section 76 has a diameter corresponding to that of the fourth section 70 of the sealing element 34 and the free end 78 thereof touches the fourth section in the low position of the cover 26, which position has been shown in FIG. 4A, and in the cover 26 intermediate position as is shown in FIG. 5A, is placed at the junction of the fourth and fifth sections 70, 72 in order to ventilate the bottle.

This free end includes a second tapered lip 80 which is intended to touch the fourth lower section 70 of the sealing coaxial element 34.

It will be understood that the second lip 80 has a defined flexibility intended to press the lip 80 against the fourth lower section 70 once the passage chamber 32 is subjected to the pressure of the product when the squeeze bottle is pressed.

Preferably, as is illustrated in particular in FIG. 1B, to improve the passage of the product and/or air in the passage chamber in order to allow effective ventilation in the intermediate position of the cover 26 as is shown in FIG. 5A, the fifth section 72 of the sealing coaxial element includes at least three channels 82 angularly spread in a regular manner on the periphery thereof.

Moreover, the fifth section 72 of the sealing coaxial element includes at least three bosses 84, each of which projects radially between two successive channels 82. These bosses 84 are intended to guide the seventh tubular section of the cover 26 onto the sealing element 30, in particular to the connection of the fourth and fifth sections 70, 72.

Moreover, the invention proposes, in a known manner, an anti-drip cap, the product outlet opening 30 of which is only uncovered when the cap 10 is supplied with product, for example when pressure is exerted on the squeeze bottle 12 on which the cap 10 is screwed.

To this end, the invention proposes an anti-drip cap 10 of the type described above, characterized in that the cover 26 is pivotably mounted between two angular positions which have been shown from FIG. 4A to FIG. 6A.

The cover 26 can firstly be immobilized in the first angular position of FIG. 4A, which is a sealing and locking low position defined by an upper stop 36 which is rigidly connected to the base 16.

By turning the cover 26 as shown in FIG. 5A, the latter is freed from the stop 36 and is placed with a reduced clearance "j" in relation to the base 16.

This intermediate position firstly allows the alignment and the connection of a countersink 86, shown in FIG. 5A, which is formed in the periphery of the sixth tapered upper section 74 with a conduit 88 which is formed in the upper wall 28 of the cover 26. The conduit 88 includes an end 90 which is coincident with the countersink 86 and an end 92 opening into the passage chamber 32.

This intermediate position secondly allows the free end of the seventh section of the cover 26 to be made coincident with the junction of the fourth and fifth sections 70, 72 of the base 16.

By continuing the rotation of the cover 26 as shown in FIG. 6A, the cover reaches a third angular position in which the cover 26 can be immobilized, and in which it can occupy the dispensing high position with the high clearance "J" in relation to the base 16 once an injection of product coming from the neck 14 of the bottle 16 exerts, on the upper wall 28 of the passage chamber 32, a pressure which is sufficient for a resulting force to exceed the force of a defined-stiffness elastic return means which is interposed in the third angular position between the cover 26 and the base 16.

More particularly, in addition to the sections 22, 23 which slide, one into the other, a cylindrical inner tubular bearing area 40 of the cover 26 receives, in a sliding manner, a cylindrical lower bearing area 44 of the base 16 in order to provide additional vertical guidance of the cover 26 onto the base 16.

The inner tubular bearing area 40 of the cover 26 includes at least one pin 46 which projects radially towards the inside of the cover 26. This pin 46 is intended to engage at least one oblong hole 42 which extends in the periphery of the lower end 44 of the base 16 along angular sector "α" corresponding to the angle formed between the first and second angular positions. The profile of the hole 42 allows, as will be seen, the cover 26 to be urged from the first position thereof for locking to the third position thereof, by way of the second intermediate position thereof.

From one end to the other, as illustrated more particularly in FIG. 10, the hole 42 includes a first section 38, with a width corresponding to the height of the pin 46, including a first end 48 of the hole 42, an upper edge 36 of which defines an upper stop position of the pin 46, therefore allowing the cover 26 to be immobilized in the sealing low position.

Then, the hole 42 includes a second section 50, with a width corresponding to the height of the pin 46, including a first boss 52, borne in particular by a lower edge 54 of the hole 46, which is placed at a distance from the first hole end corresponding substantially to the width of the pin 46, which defines, with the first end, the first angular position associated with the sealing low position, and which the pin 46 can cross over when the cover 26 is rotated.

Then, the hole 42 includes a third section 56, with a width corresponding to the height of the pin 46, including a first bearing 57, borne at least by a lower edge of the hole 42, which is intended to raise the pin 46 and, therefore, the cover 26 to the defined reduced clearance "j". The reduced clearance "j" is reached once the first bearing 56 has been crossed from a defined angle of rotation, in order to define the second intermediate angular position associated with the ventilation of the bottle 12.

Then, the hole 42 includes a fourth section 58, with a width corresponding to the height of the pin 46, including a second boss 60, borne in particular by a lower edge of the hole 42, which is placed at a distance from a second end 62 of the hole corresponding substantially to the width of the pin 46, which defines, with the second end 62, the third angular position associated with the dispensing high position, and which the pin 46 can cross over when the cover 26 is rotated.

Finally, the hole 42 includes a fifth section 64, which extends between the second boss 60 and the second end 62 of the hole 42, once the second boss 60 has been crossed from a defined angle of rotation, an elastically returned upper edge 66 of which is intended to allow the pin 46 of the cover to be raised to the high clearance "J", once an injection of product coming from the neck 14 of the bottle 12 exerts, on the upper wall 28 of the passage chamber, a pressure which is sufficient for a resulting force to exceed the force of the elastic return means of said upper edge 66 in order to define the third intermediate angular position associated with the dispensing high position.

It will be understood that several embodiments can be carried out to elastically return the upper edge 66 of the lug 94. The lug could, for example, be a vertically sliding lug.

However, in the preferred embodiment of the invention, the upper edge 66 of the fifth section 64 is borne by a flexible elastic lug 94, a first end 96 of which consists of a single piece with a first cylindrical part 98 of a body of the base, and which extends with a defined clearance "e" about a second cylindrical part 102 of the body 100 of the base with a diameter that is less than the first cylindrical part 98.

A second end 104 of the lug 94, which is free, includes a lower edge which forms at least the upper edge 66 of the fifth section 64.

In the preferred embodiment of the invention, to avoid any risk of the cover 26 jamming, the inner tubular bearing area 40 of the cover 26 includes at least two diametrically opposite pins 46. In a complementary manner, the base 16 includes two diametrically opposite holes 42 and two elastic lugs 94.

It will be understood in the light of the present description that, preferably, the base 16 and the cover 26 are each made from an injected plastic.

Therefore, the invention proposes an anti-drip cap 10 that is particularly innovative, in that it allows the dispersion and drying of the product to be prevented, and advantageous, in that it is formed from a limited number of pieces, and can therefore, in this respect, be mass-produced at a reduced cost.

The invention claimed is:

1. A anti-drip cap (10) for a deformable squeeze bottle (12), containing a cosmetic, pharmaceutical, industrial or food product in liquid or cream form, said cap comprising:

a substantially tubular base (16) with first tubular section (22) having a transverse wall (25) that includes at least one lower inlet opening (24), and a sealing element (34) that projects coaxially with the base (16) from the transverse wall (25), the first tubular section being an external section with an inner bore, the base being fixable in an impermeable manner on a complementary tubular neck (14) of the bottle (12); and a substantially tubular cover (26) that covers the base (16) in an impermeable manner, the cover (26) comprising a second tubular section (23) that includes a first lip (35), the first lip being substantially tapered lip (35) and is closed by an upper transverse wall (28) that includes at least one upper product outlet opening (30), the second tubular section being mounted inside the first tubular section, the first and second tubular sections (22, 23) being mounted in a sliding manner, one within the other, and defining, in an impermeable manner, a passage chamber (32) for passage of the product, the passage chamber (32) being interposed between the inlet opening (24) of the base (16) and the product outlet opening (30), wherein an end (33) of the first lip (35) of the second tubular section is inside the passage chamber (32), wherein said cover (26) is vertically movable between at least:

a sealing and locking low position in which the cover (26) is immobilized on the base (16) and in which the product outlet opening (30) is lowered onto the sealing element (34), said sealing element (34) sealing the product outlet opening (30), an intermediate position, in which relative positions of the cover (26) and of the base (16) define an escape path with dimensions connecting the product outlet opening (30) with the passage chamber (32) in order to ventilate the squeeze bottle (12) allowing, in particular, the squeeze bottle (12) to regain the shape thereof once pressed, and a dispensing high position in which the product outlet opening (30) is placed with a defined high clearance (J) above the sealing element (34) in order to allow the product to pass through the inlet opening (24) and the product outlet opening (30) and the passage chamber (32), once the squeeze bottle (12) is pressed, wherein the first tapered lip (35) touches the inner bore of the first tubular section, wherein the sealing coaxial element (34) includes i) a cylindrical lower section (70), ii) an intermediate section (72) with a substantially tapered shape and a diameter of less than a diameter of the cylindrical lower section (70), and iii) a tapered upper section (74) that is complementary to the product outlet opening (30), and wherein the cover (26) includes a cover tubular section (76) which extends coaxially inside the second tubular section (23) from the upper transverse wall (28), with a diameter corresponding to the diameter of the cylindrical lower section (70), a free end (78) of the cover tubular section (76) being placed at a junction of the cylindrical lower section (70) and the intermediate section (72) of the sealing element (34) in the intermediate position of the cover (26) in order to ventilate the squeeze bottle (12), the free end (78) including a tapered second lip (80) that touches the cylindrical lower section (70) in the intermediate position of the cover (26).

2. The cap (10) as claimed in claim 1, wherein the first lip (35) has a defined flexibility intended to press the first lip (35) against said bore once the passage chamber (32) is subjected to the pressure of the product when the squeeze bottle (12) is pressed.

3. The cap (10) as claimed in claim 1, wherein the second lip (80) has a defined flexibility which is intended to press the second lip (80) against the cylindrical lower section (70) once the passage chamber (32) is subjected to the pressure of the product when the squeeze bottle is pressed.

4. The cap (10) as claimed in claim 1, wherein the intermediate section (72) of the sealing coaxial element includes at least three channels (82) angularly spread in a regular manner on the periphery thereof, which at least three channels (82) improve the passage of the product or air in the passage chamber (32).

5. The cap (10) as claimed in claim 4, wherein the intermediate section (72) of the sealing coaxial element includes at least three bosses (84), each of which projects radially between two successive ones of the at least three channels (82), the at least three bosses (84) guiding the cover tubular section (76) onto the sealing element (34).

6. The cap (10) as claimed in claim 1, further comprising:

a upper stop (36) rigidly connected to the base;

a countersink (86) formed in a periphery of the tapered upper section (74) of the sealing element (34);

a conduit (88) formed in the upper transverse wall (28) of the cover (26), the conduit connecting a periphery of the product outlet opening (30) and the passage chamber (32); and a defined-stiffness elastic return means, wherein, the cover (26) is mounted pivotably and manually between:

a first angular position in which the cover (26) can be immobilized and in which the cover occupies a sealing and locking low position defined by the upper stop (36) which is rigidly connected to the base (16), at least one second intermediate angular position, in which the cover (26) is released from the stop (36) and is placed with a reduced clearance (j) from the base (16) in order to:

allow alignment and connection of the countersink (86) with the conduit (88), match up the free end (78) with the junction of the cylindrical lower section (70) and the intermediate section (72), in order to ventilate the bottle (12), and a third angular position in which the cover (26) can be immobilized, and in which the cover can occupy the dispensing high position with the high clearance (J) once an injection of product coming from the neck (14) of the bottle (12) exerts, on an upper wall of the passage chamber (32), a pressure that is sufficient for a resulting force to exceed a force of the defined-stiffness elastic return means, in the third angular position, the defined-stiffness elastic return means being interposed between the cover (26) and the base (16).

7. The cap (10) as claimed in claim 6, further comprising:

an inner tubular bearing area (40)in the cover (26); and at least one oblong hole (42) which extends in a periphery of a lower end (44) of the base (16), wherein, the inner tubular bearing area (40) of the cover (26) includes at least one pin (46), projecting radially towards an inside of the cover (26), which is intended to engage the at least one oblong hole (42) along an angular sector corresponding to an angle formed between the first and second angular positions, and a profile of the at least one oblong hole (42) allows the cover (26) to be urged from the first position thereof for locking to the third position thereof, by way of the second intermediate position thereof.

8. The cap (10) as claimed in claim 7, wherein the at least one oblong the hole (42) includes:

a first section (38), with a width corresponding to a height of the at least one pin (46), the first section (38) including a first end of the hole, an upper edge (36) of which defines an upper stop position of the pin (46) allowing the cover (26) to be immobilized in the sealing low position, a second section (50), with a width corresponding to the height of the pin (46), the second section (50) including a first boss (52), borne by a lower edge (54) of the hole (42), which is placed at a distance from the first hole end (38) corresponding substantially to a width of the pin (46), which defines, with the first end (38), the first angular position associated with the sealing low position, and which the pin (46) can cross over when the cover (26) is rotated, a third section (56), with a width corresponding to the height of the pin (46), the third section (56) including a first bearing (57), borne at least by the lower edge of the hole (42), which is intended to raise the pin and the cover to the defined reduced clearance "j" once the first bearing (57) has been crossed from a defined angle of rotation, in order to define the second intermediate angular position associated with the ventilation of the bottle (12), a fourth section (58), with a width corresponding to the height of the pin (46), the fourth section (58) including a second boss (60), borne by the lower edge of the hole (42), which is placed at a distance from a second end (62) of the hole corresponding substantially to the width of the pin (46), which defines, with the second end (62), the third angular position associated with the dispensing high position, and which the pin (46) can cross over when the cover (26) is rotated, and a fifth section (64), which extends between the second boss (60) and the second end (62) of the hole, once the second boss (60) has been crossed from a defined angle of rotation, an elastically returned upper edge (66) of which is intended to allow the pin (46) of the cover to be raised to the high clearance "J", once an injection of product coming from the neck of the bottle (12) exerts, on the upper wall (28) of the passage chamber, a pressure which is sufficient for a resulting force to exceed a force of said upper edge (66) in order to define the third intermediate angular position associated with the dispensing high position.

9. The cap (10) as claimed in claim 8, wherein the upper edge (66) of the fifth section (64) is borne by an elastic lug (94), a first end (96) of which consists of a single piece with a first cylindrical part (98) of a body (100) of the base, and which extends with a defined clearance (e) about a second cylindrical part (102) of the body (100) of the base, a second end (104) of which is free, and a lower edge of which forms at least the upper edge (66) of the fifth section (64).

10. The cap (10) as claimed in claim 9, wherein the inner tubular bearing area (40) of the cover (26) includes at least two diametrically opposite pins (46), and the base (16) includes two elastic lugs (94) and two holes (42) which are diametrically opposite.

11. The cap (10) as claimed in claim 1, wherein the base includes at least two holes (24) in a shape of crescents which are angularly spread in a regular manner about the sealing element, which each form an inlet opening of the passage chamber.

12. The cap (10) as claimed in claim 1, wherein the lower end (44) of the base (16) and the cover (26) include complementary cylindrical bearing areas (40, 44) that engage one another in order to provide additional vertical guidance of the cover (26).

13. The cap (10) as claimed in claim 1, wherein the base (16) and the cover (26) are each made from an injected plastic.

14. The cap (10) as claimed in claim 3, wherein the intermediate section (72) of the sealing coaxial element includes at least three channels (82) angularly spread in a regular manner on the periphery thereof, which at least three channels (82) improve the passage of the product or air in the passage chamber (32).

15. The cap (10) as claimed in claim 3, wherein the intermediate section (72) of the sealing coaxial element includes at least three bosses (84), each of which projects radially between two successive ones of the at least three channels (82), the at least three bosses (84) guiding the cover tubular section (76) onto the sealing element (34).

16. The cap (10) as claimed in claim 3, further comprising:

a upper stop (36) rigidly connected to the base;

a countersink (86) formed in a periphery of the tapered upper section (74) of the sealing element (34);

a conduit (88) formed in the upper transverse wall (28) of the cover (26), the conduit connecting a periphery of the product outlet opening (30) and the passage chamber (32); and a defined-stiffness elastic return means, wherein, the cover (26) is mounted pivotably and manually between:

a first angular position in which the cover (26) can be immobilized and in which the cover occupies a sealing and locking low position defined by the upper stop (36) which is rigidly connected to the base (16), at least one second intermediate angular position, in which the cover (26) is released from the stop (36) and is placed with a reduced clearance (j) from the base (16) in order to:

allow alignment and connection of the countersink (86) with the conduit (88), match up the free end (78) with the junction of the cylindrical lower section (70) and the intermediate section (72), in order to ventilate the bottle (12), and a third angular position in which the cover (26) can be immobilized, and in which the cover can occupy the dispensing high position with the high clearance (J) once an injection of product coming from the neck (14) of the bottle (12) exerts, on an upper wall of the passage chamber (32), a pressure that is sufficient for a resulting force to exceed a force of the defined-stiffness elastic return means, in the third angular position, the defined-stiffness elastic return means being interposed between the cover (26) and the base (16).

17. The cap (10) as claimed in claim 4, further comprising:

a upper stop (36) rigidly connected to the base;

a countersink (86) formed in a periphery of the tapered upper section (74) of the sealing element (34);

a conduit (88) formed in the upper transverse wall (28) of the cover (26), the conduit connecting a periphery of the product outlet opening (30) and the passage chamber (32); and a defined-stiffness elastic return means, wherein, the cover (26) is mounted pivotably and manually between:

a first angular position in which the cover (26) can be immobilized and in which the cover occupies a sealing and locking low position defined by the upper stop (36) which is rigidly connected to the base (16), at least one second intermediate angular position, in which the cover (26) is released from the stop (36) and is placed with a reduced clearance (j) from the base (16) in order to:

allow alignment and connection of the countersink (86) with the conduit (88), match up the free end (78) with the junction of the cylindrical lower section (70) and the intermediate section (72), in order to ventilate the bottle (12), and a third angular position in which the cover (26) can be immobilized, and in which the cover can occupy the dispensing high position with the high clearance (J) once an injection of product coming from the neck (14) of the bottle (12) exerts, on an upper wall of the passage chamber (32), a pressure that is sufficient for a resulting force to exceed a force of the defined-stiffness elastic return means, in the third angular position, the defined-stiffness elastic return means being interposed between the cover (26) and the base (16).

* * * * *